US008808023B2

(12) United States Patent
Funston

(10) Patent No.: US 8,808,023 B2
(45) Date of Patent: Aug. 19, 2014

(54) LAMPHOLDER-SOCKET-SUPPORTED ELECTRICAL APPLIANCE

(76) Inventor: Lance Thomas Funston, Penn Valley, PA (US)

( * ) Notice: Subject to any disclaimer, the term of this patent is extended or adjusted under 35 U.S.C. 154(b) by 245 days.

(21) Appl. No.: 13/435,198

(22) Filed: Mar. 30, 2012

(65) Prior Publication Data

US 2013/0051019 A1 Feb. 28, 2013

Related U.S. Application Data

(60) Provisional application No. 61/527,838, filed on Aug. 26, 2011.

(51) Int. Cl.
*H01R 13/64* (2006.01)

(52) U.S. Cl.
USPC ..... 439/375

(58) Field of Classification Search
USPC ..... 439/475, 473–474, 923, 301
See application file for complete search history.

(56) References Cited

U.S. PATENT DOCUMENTS

| | | | | | |
|---|---|---|---|---|---|
| 4,548,439 | A * | 10/1985 | Bienert et al. | ..... | 296/223 |
| 4,619,162 | A * | 10/1986 | Van Laere | ..... | 81/464 |
| 5,993,246 | A * | 11/1999 | Moldenhauer et al. | ..... | 439/474 |
| 6,494,730 | B1 * | 12/2002 | Yan | ..... | 439/226 |
| 6,663,397 | B1 * | 12/2003 | Lin et al. | ..... | 439/63 |
| 7,438,497 | B2 * | 10/2008 | Yoshino et al. | ..... | 403/408.1 |
| 2007/0117466 | A1 * | 5/2007 | Thiele et al. | ..... | 439/660 |
| 2011/0137665 | A1 * | 6/2011 | Acworth | ..... | 705/1.1 |
| 2012/0134654 | A1 * | 5/2012 | Chan | ..... | 392/407 |

* cited by examiner

*Primary Examiner* — Jean F Duverne
(74) *Attorney, Agent, or Firm* — Panitch Schwarze Belisario & Nadel LLP

(57) ABSTRACT

An electrical appliance for a lampholder socket having a socket axis of rotation has a housing rotatable by an application of an applied torque thereto. A screw base is configured to be inserted in the lampholder socket and threadedly connected to the lampholder socket upon a rotation of the screw base in a first direction about the socket axis of rotation. A torque limiter is fixedly attached to the screw base for rotation therewith. The torque limiter couples the housing to the screw base for rotation therewith when the applied torque is less than a predetermined magnitude and couples the housing to the screw base for rotation relative thereto when the applied torque is greater than the predetermined magnitude. An electrical device is mounted in the housing and electrically connected to the screw base.

17 Claims, 11 Drawing Sheets

*Fig. 13A*
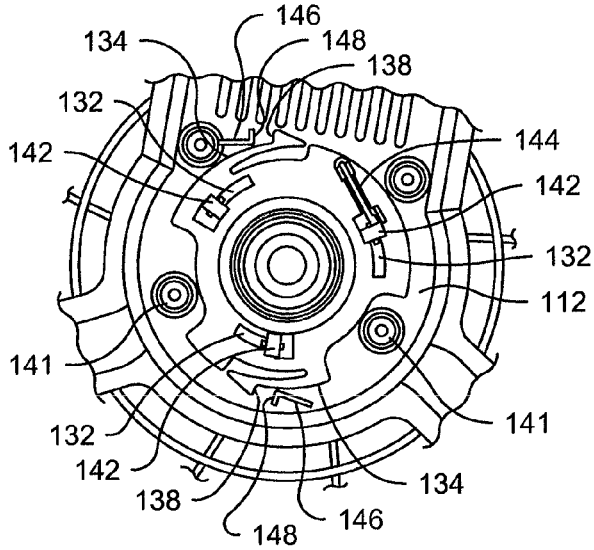
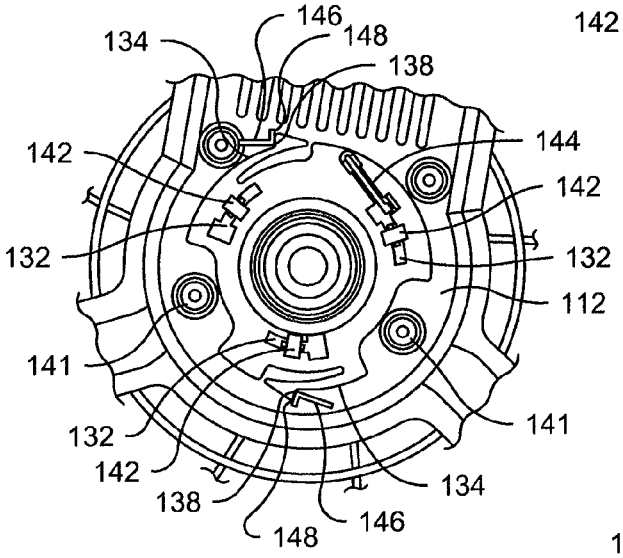
*Fig. 13B*
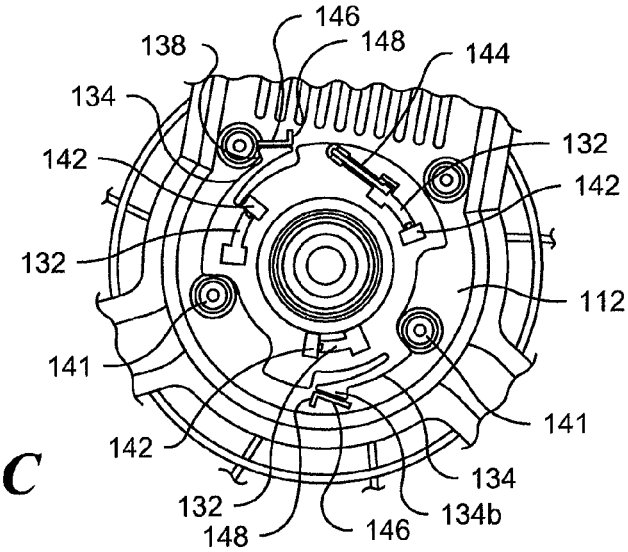
*Fig. 13C*

LAMPHOLDER-SOCKET-SUPPORTED ELECTRICAL APPLIANCE

CROSS-REFERENCE TO RELATED APPLICATIONS

This application is related to and claims the filing date of U.S. Provisional Patent Application No. 61/527,838 filed Aug. 26, 2011, and incorporated herein by reference.

BACKGROUND OF THE INVENTION

The present invention relates to an electrical appliance for a lampholder socket. More particularly, the present invention relates to a lampholder-socket-supported fan for use in an Edison type lampholder socket.

Screw-type lampholder sockets are designed to receive and threadedly retain the corresponding screw bases of conventional light bulbs. In typical residential applications, the lampholder socket is usually a ceiling-mounted, medium screw-base socket, the manufacture and installation of which is governed by the National Electric Code®. The standard electrical enclosure boxes and mounting brackets used in such installations are sized to withstand the torque required to snuggly tighten a bulb in the threaded socket. When the screw base of an electrical appliance that is larger than a light bulb is inserted in the socket and snuggly tightened, the socket may be subject to inadvertent over-torquing. The resulting damage to the socket may be hazardous and could possibly initiate an electrical fire.

Accordingly, there is a need for a device that prevents over-torquing a screw-type lampholder socket when large electrical appliances are inserted in such sockets and snuggly tightened.

BRIEF SUMMARY OF THE INVENTION

Briefly stated, one embodiment of the present invention is directed to an electrical appliance for a lampholder socket having a socket axis of rotation. The electrical appliance comprises a housing rotatable by an application of an applied torque thereto. A screw base is configured to be inserted in the lampholder socket and threadedly connected to the lampholder socket upon a rotation of the screw base in a first direction about the socket axis of rotation. A torque limiter is fixedly attached to the screw base for rotation therewith. The torque limiter couples the housing to the screw base for rotation therewith when the applied torque is less than a predetermined magnitude and couples the housing to the screw base for rotation relative thereto when the applied torque is greater than the predetermined magnitude. An electrical device is mounted in the housing and electrically connected to the screw base

THE DRAWINGS

The foregoing summary, as well as the following detailed description of preferred embodiments of the invention, will be better understood when read in conjunction with the appended drawings. For the purpose of illustrating the invention, there is shown in the drawings embodiments which are presently preferred. It should be understood, however, that the invention is not limited to the precise arrangements and instrumentalities shown.

In the drawings:

FIGS. 13A-13C are bottom plan views of a portion of the top housing of the lampholder-socket-supported electronic appliance of FIG. 8 with the torque assembly mounted therein in a first position (FIG. 123A), rotated counter-clockwise to a second position (FIG. 13B) and further rotated counter-clockwise to a third position (FIG. 13C);

Figure 7:
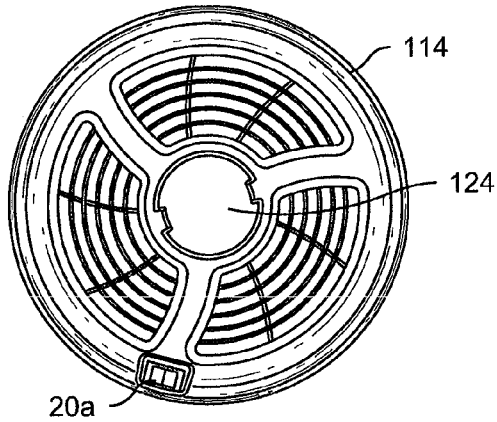
FIG. 7 is a bottom plan view of the lampholder-socket-supported electronic appliance of FIG. 2 with the shroud replaced by a removable cap.
Figure 8:
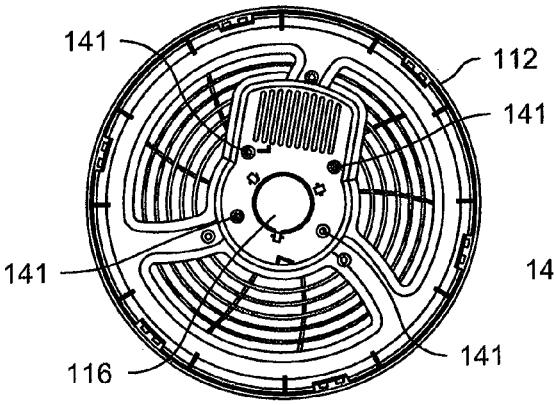
FIG. 8 is a bottom plan view of the top housing of the lampholder-socket-supported electronic appliance of FIG. 2.
Figure 9:
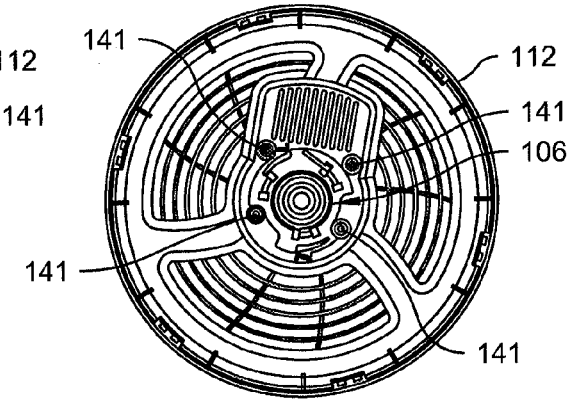
FIG. 9 is a bottom plan view of the top housing of the lampholder-socket-supported electronic appliance of FIG. 8 with the torque assembly rotatably mounted therein.
Figure 10:
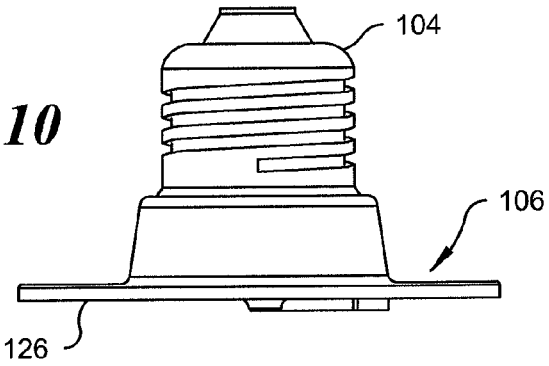
FIG. 10 is a front side elevational view of the torque assembly of FIG. 9.
Figure 11:
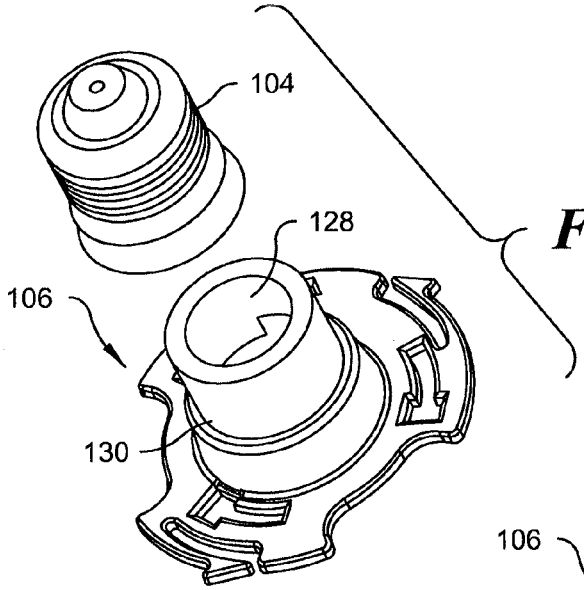
FIG. 11 is an exploded top perspective view of the torque assembly of FIG. 10.
Figure 12:
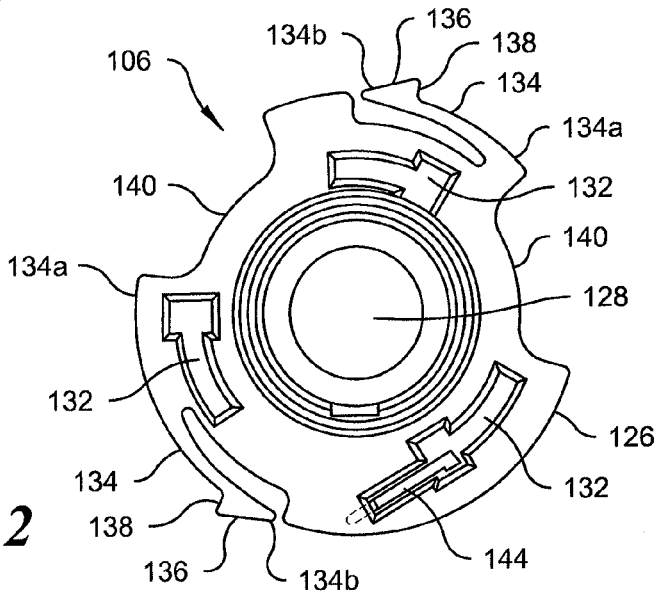
FIG. 12 is a top plan view of the torque plate of FIG. 10.
Figure 14A:
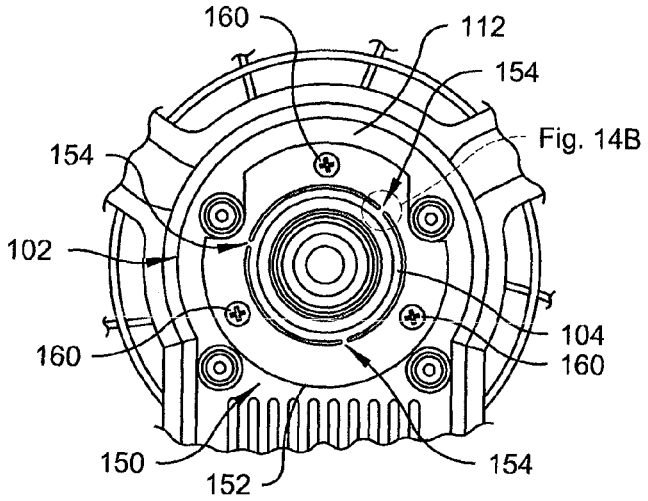
Figure 14B:
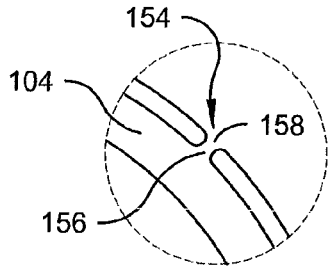
Figure 14C:
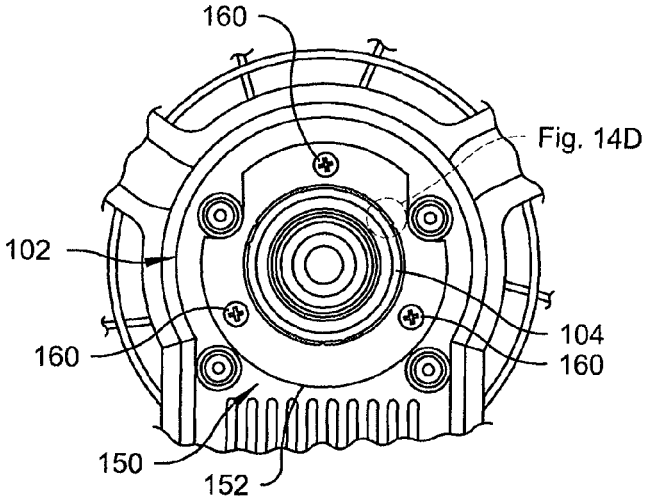
Figure 14D:
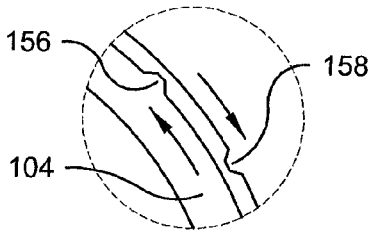
Figure 15A:
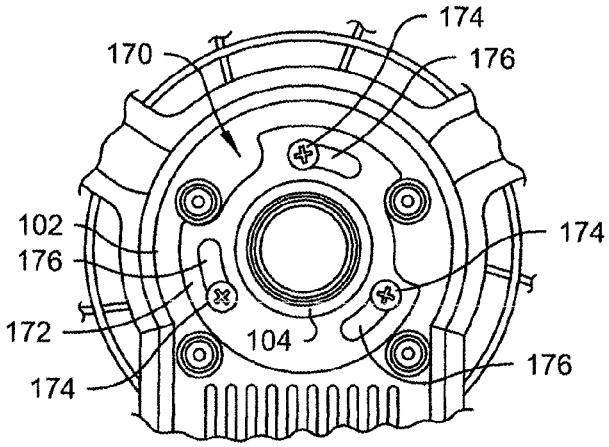
Figure 15B:
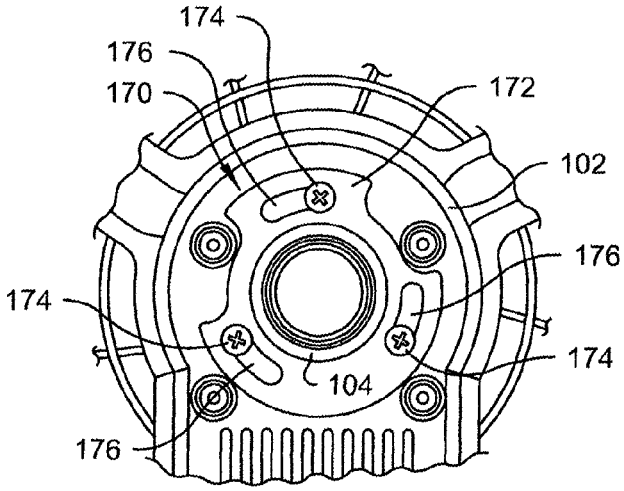
Figure 16A:
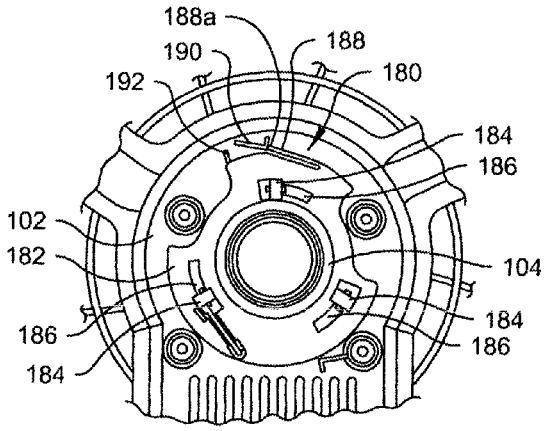
Figure 16B:
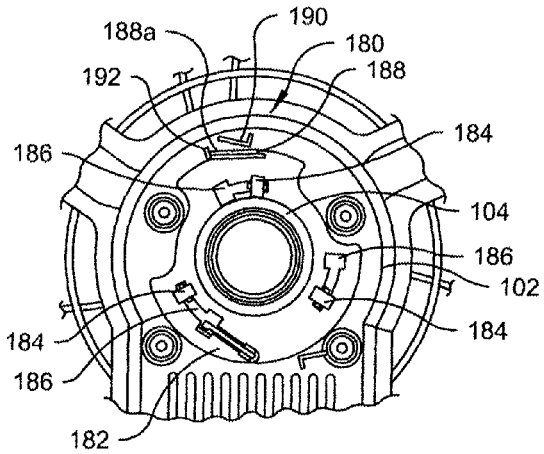
Figure 17A:
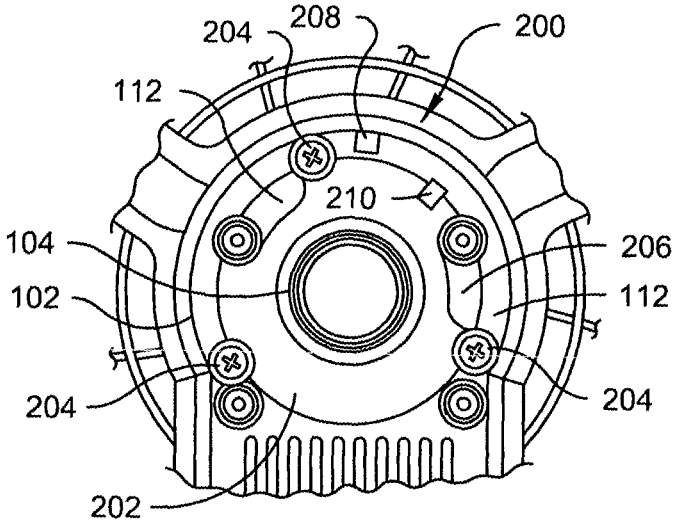
Figure 17B:
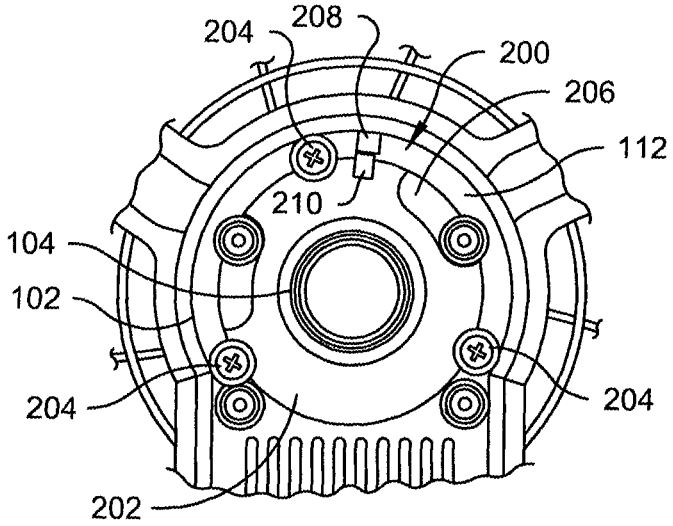
Figure 18:
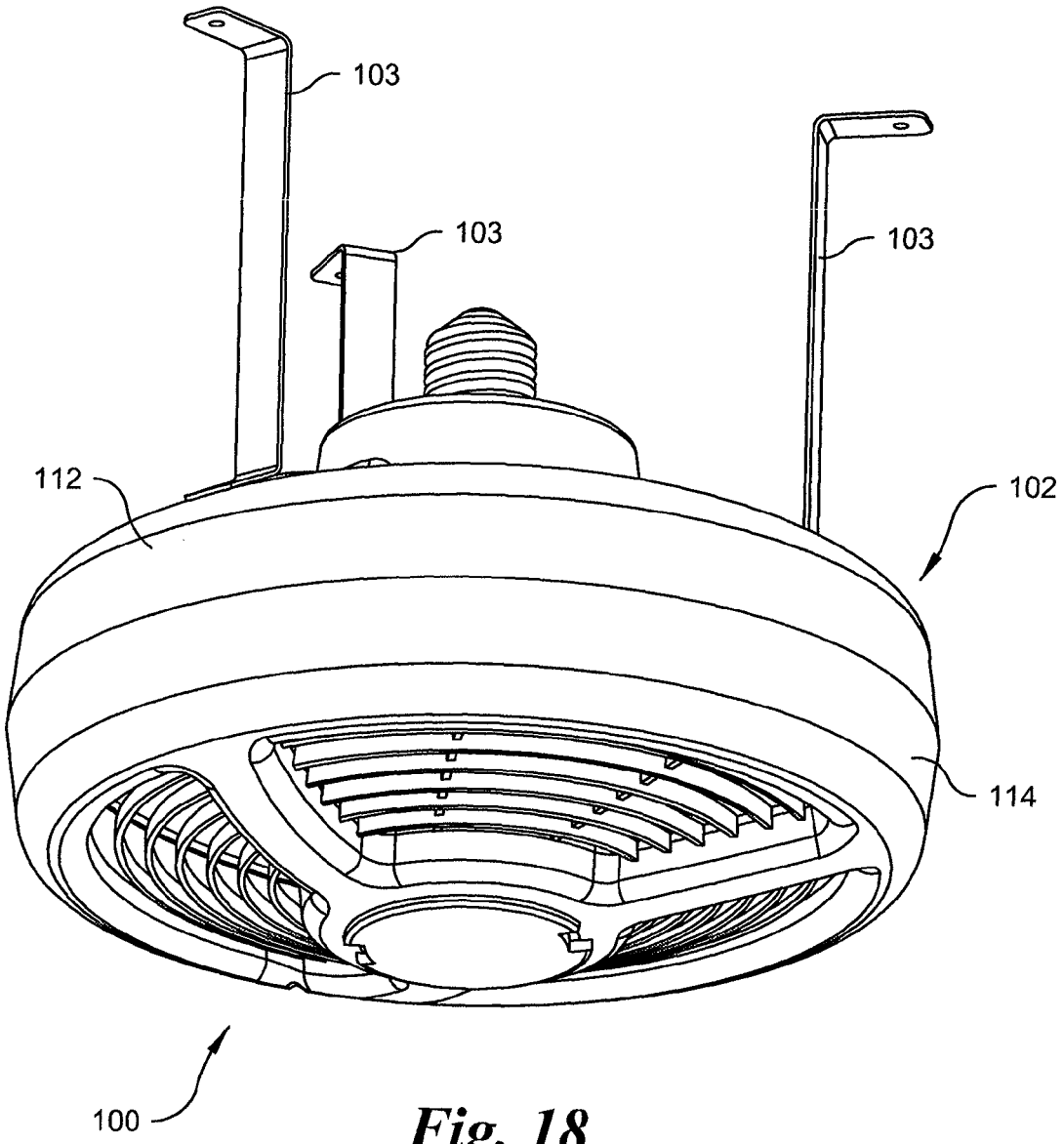
Figure 19:
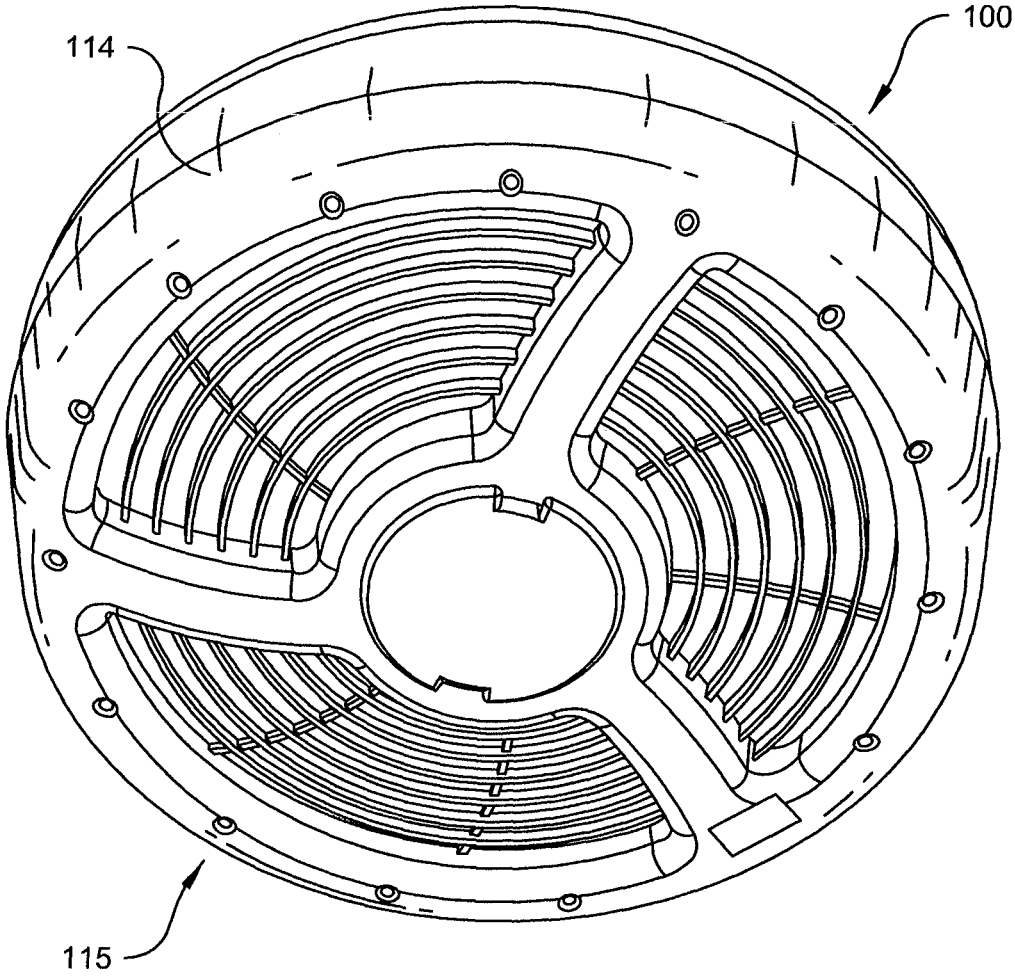

FIGS. 14A-14D are bottom plan views of a portion of the top housing of the lampholder-socket-supported electronic appliance of FIG. 8 with another embodiment of a torque assembly mounted therein and having a breakaway member in accordance with the present invention, the torque assembly being shown in a first position (FIG. 14A), an enlarged portion of which is shown in FIG. 14B, and rotated counter-clockwise to a second position (FIG. 14C), an enlarged portion of which is shown in FIG. 14D;

FIGS. 15A and 15B are bottom plan views of a portion of the top housing of the lampholder-socket-supported electronic appliance of FIG. 8 with another embodiment of a torque assembly mounted therein in accordance with the present invention torque assembly being shown in a first position (FIG. 15A) and rotated counter-clockwise to a second position (FIG. 15B);

FIGS. 16A and 16B are bottom plan views of a portion of the top housing of the lampholder-socket-supported electronic appliance of FIG. 8 with another embodiment of a torque assembly of the present invention mounted therein and having an audible sound generator, the torque assembly being shown in a first position (FIG. 17A) and rotated counter-clockwise to a second position (FIG. 17B);

FIGS. 17A and 17B are bottom plan views of a portion of the top housing of the lampholder-socket-supported electronic appliance of FIG. 8 with another embodiment of a torque assembly mounted therein in accordance with the present invention, the torque assembly being shown in a first position (FIG. 17A) and rotated counter-clockwise to a second position (FIG. 17B);

FIG. 18 is a bottom perspective view of another embodiment of the lampholder-socket-supported electronic appliance of FIG. 7 having a support struts in accordance with the present invention; and FIG. 19 is bottom, rear side perspective view of another embodiment of the lampholder-socket-supported electronic appliance of FIG. 7 having a circumferential ring of light emitting diodes having support struts.

DETAILED DESCRIPTION OF THE INVENTION

Reference will now be made in detail to embodiments of the invention, examples of which are illustrated in the accompanying drawings. The terminology used in the description of the invention herein is for the purpose of describing particular embodiments only and is not intended to be limiting of the invention.

As used in the description of the invention and the appended claims, the singular forms "a", "an" and "the" are intended to include the plural forms as well, unless the context clearly indicates otherwise. The words "and/or" as used herein refers to and encompasses any and all possible combinations of one or more of the associated listed items. The words "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

The words "right," "left," "lower," "upper," "top" and "bottom" designate directions in the drawings to which reference is made. The words "inwardly" and "outwardly" refer to directions toward and away from, respectively, the geometric center of the needle safety shield, and designated parts thereof. The terminology includes the words noted above, derivatives thereof and words of similar import.

Although the words first, second, etc., are used herein to describe various elements, these elements should not be limited by these words. These words are only used to distinguish one element from another. For example, a first direction could be termed a second direction, and, similarly, a second direction could be termed a first direction, without departing from the scope of the present invention.

As used herein, the words "if" may be construed to mean "when" or "upon" or "in response to determining" or "in response to detecting," depending on the context. Similarly, the phrase "if it is determined" or "if [a stated condition or event] is detected" may be construed to mean "upon determining" or "in response to determining" or "upon detecting [the stated condition or event]" or "in response to detecting [the stated condition or event]," depending on the context.

The following description is directed towards various embodiments of a lampholder-socket-supported appliance in accordance with the present invention.

Figure 1:
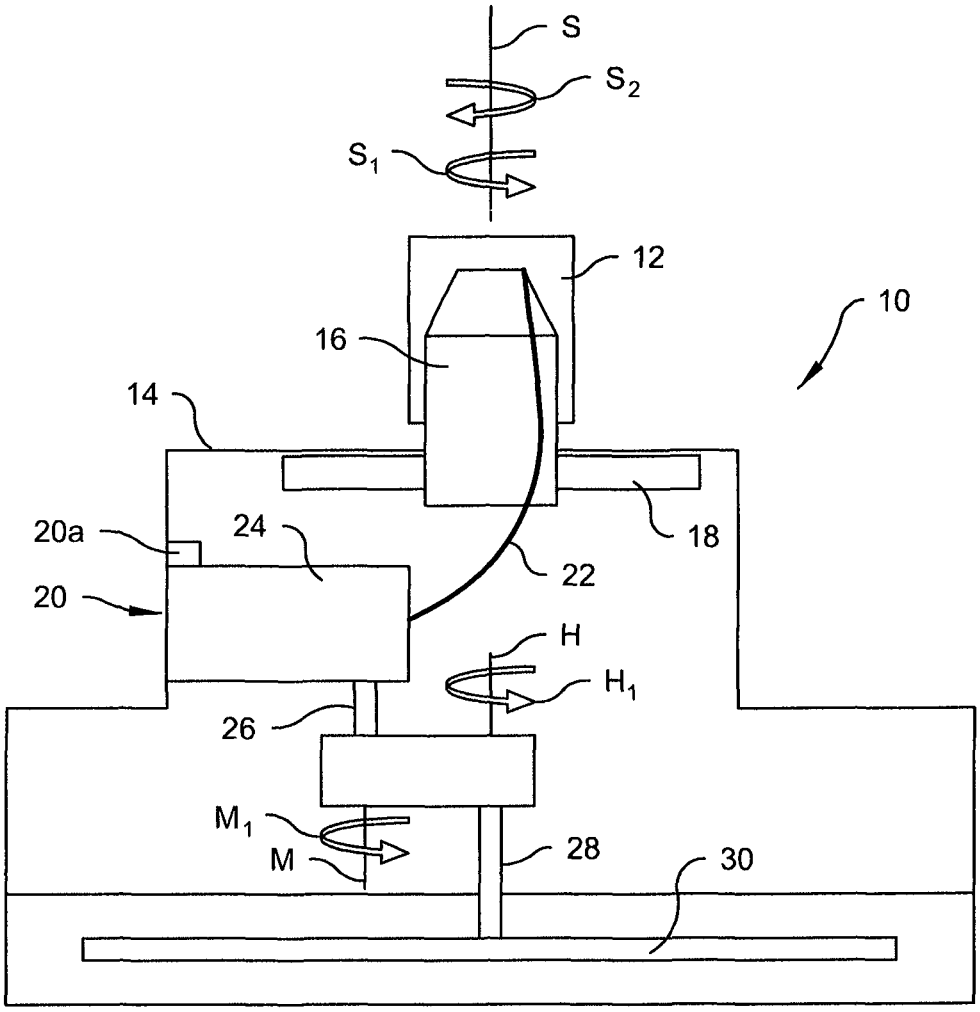
FIG. 1 is a block diagram of a first embodiment of a lampholder-socket-supported electronic appliance in accordance with the present invention.
Figure 2:
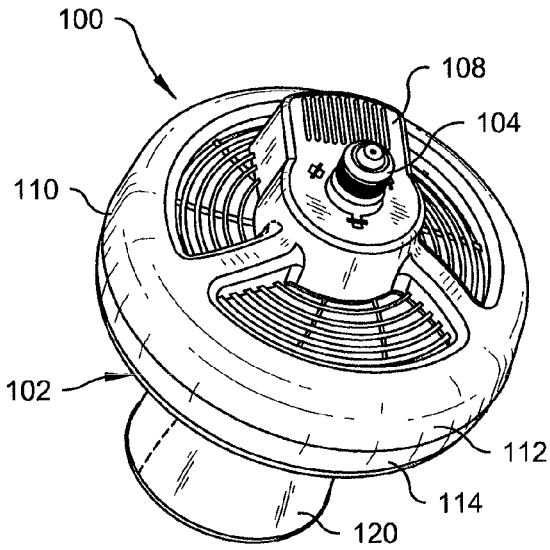
FIG. 2 is a top, front perspective view of a second embodiment of a lampholder-socket-supported electronic appliance in accordance with the present invention.
Figure 3:
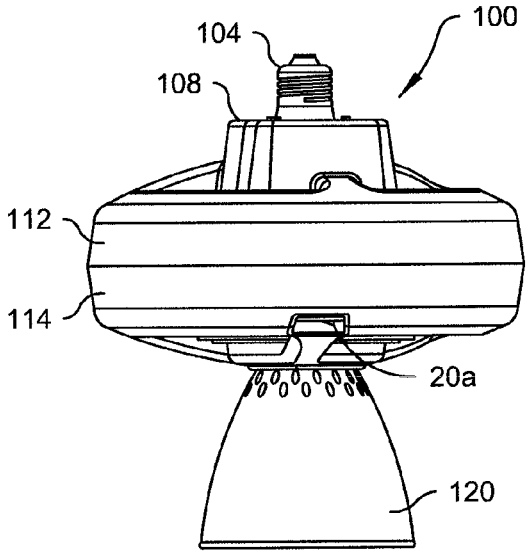
FIG. 3 is a front side elevation view of the lampholder-socket-supported electronic appliance of FIG. 2.
Figure 4:
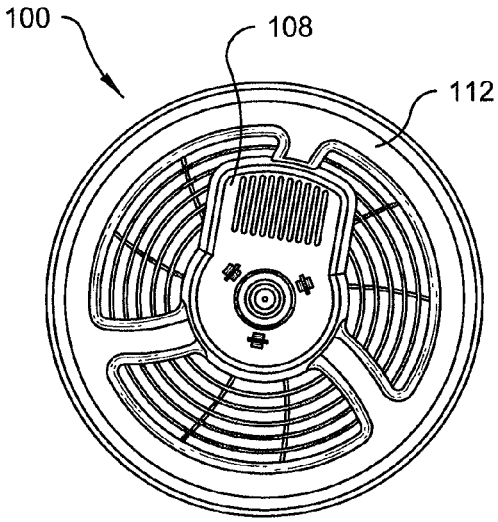
FIG. 4 is a top plan view of the lampholder-socket-supported electronic appliance of FIG. 2.
Figure 5:
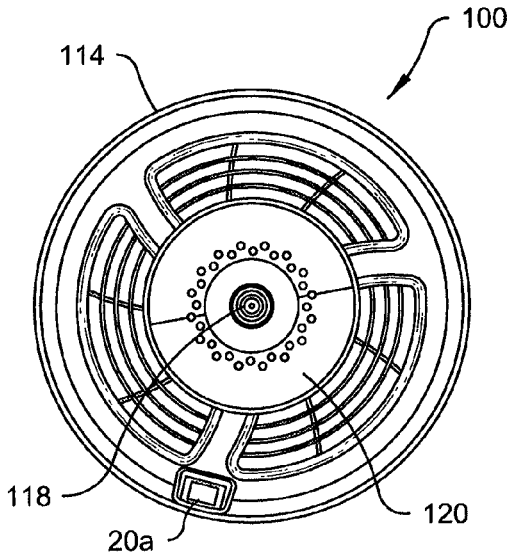
FIG. 5 is a bottom plan view of the lampholder-socket-supported electronic appliance of FIG. 2.
Figure 6:
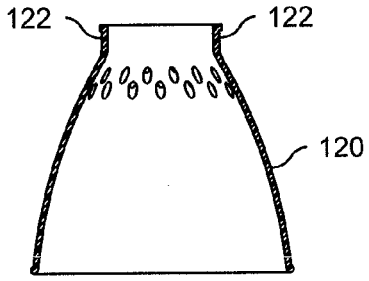
FIG. 6 is a cross sectional view of the shroud of the lampholder-socket-supported electronic appliance of FIG. 2.

A block diagram of a first preferred embodiment of an electrical appliance, generally designated 10, and hereinafter referred to as the "Electrical Appliance" 10 in accordance with the present invention is shown in FIG. 1. The Electrical Appliance 10 is for use in a lampholder socket 12 having a socket axis of rotation S. The lampholder socket 12 may be any screw-type socket such as the commonly known Edison-type socket originally disclosed in 1881 in U.S. Pat. No. 251,554, incorporated herein by reference, and modern variants thereof.

The Electrical Appliance 10 comprises a housing 14 coupled to a screw base 16 by a torque limiter 18 fixedly attached to the screw base 16 for rotation therewith. The screw base 16 is configured to be inserted in the lampholder socket 12 and threadedly connected to the lampholder socket 12 upon application of an applied torque to the housing 14 causing a rotation of the screw base 14 in a first screw-base rotational direction $S_1$ about the socket axis of rotation S. The torque limiter 18 is configured to couple the housing 14 to the screw base 16 for rotation therewith when the torque applied to the housing 14 is less than a predetermined magnitude and to couple the housing 14 to the screw base 16 for rotation relative thereto when the applied torque is greater than the predetermined magnitude. In some embodiments, the screw base 16 is disconnectable from the lampholder socket 12 upon a rotation of the screw base 16 in a second screw-base rotational direction $S_2$ about the socket axis of rotation S opposite the first socket rotational direction $S_1$.

An artisan will understand that the permissible predetermined magnitude for applied torque is dependent on the physical characteristics of particular lampholder sockets and the manner in which the sockets have been installed in given applications. For example, in residential applications, where the lampholder socket is a medium screw base lampholder, the installation of which is governed by the National Electric Code® and the Underwriter Laboratories Standard for Self-Ballasted Lamps and Lamp Adapters (UL 1993/CSA C22.2 No. 1993-09), the predetermined magnitude for applied torque is suggestedly no more than about 2.82 N-m (25 lb-in), desirably about 2.49 N-m (22 lb-in) or less, preferably about 2.26 N-m (20 lb-in), and more preferably about 2.03 N-m (18 lb-in) or less.

An electrical device 20 having an On/Off switch **20*a* is mounted in the housing 14 and is electrically connected to the screw base 16 by an electrical conductor 22. In some embodiments, the electrical device 20 may be a motor 24 having a drive shaft 26 rotatable about a motor axis of rotation M spaced from the socket axis of rotation S. The motor 24 may be rotatable only in a single motor rotational direction $M_1$ corresponding to the first screw-base rotational direction $S_1$ and may not change due to a reversal of a polarity of the motor. In some embodiments, the motor 24 may be a fractional horse power motor. In some embodiments, the drive shaft 26 may be operatively coupled to a hub 28 rotatably supported by the housing 14 and the hub 28 may have a hub axis of rotation H coincident with the socket axis of rotation S. In some embodiments, at least one impeller 30 may be attached to the hub 28 and may rotate about the hub axis of rotation H in a first hub rotational direction $H_1$, preferably the same direction as the first screw-base rotational direction $S_1$. In some embodiments, the both the hub 28 and the at least one impeller 30 may be enclosed within the housing 14. In some embodiments, another lampholder socket (not shown) may be mounted in the housing and electrically connected to the screw base 16**.

Referring to the drawings in detail, where like numerals indicate like elements throughout, there is shown in FIG. 2-13C a second preferred embodiment of an electrical appliance for a lampholder socket. The second embodiment is a Lampholder-Socket-Supported Fan, generally designated 100, and hereinafter referred to as the "LSS Fan" 100 in accordance with the present invention. The LSS Fan is for use in a screw-type lampholder socket such as the socket 12 shown in FIG. 1.

The LSS Fan 100 comprises a housing 102 coupled to a screw base 104 by a torque limiter 106 fixedly attached to the screw base 104 for rotation therewith. The housing 102 provides a motor enclosure 108 in combination with a mechanical fan guard 110. The housing 102 is preferably fabricated as a two-part polymeric molding comprising a housing top 112 and a housing bottom 114 to allow for the mounting of components therein. The housing top 112 has a centrally located bore 116 (see FIG. 8). The portion of the housing top 112 forming the motor enclosure 108 is offset from the bore 116. The screw base 104 extends through the bore 116 and is configured to be inserted in a lampholder socket, such as the socket 12 (see FIG. 1) and be threadedly connected to the lampholder socket upon application of an applied torque to the housing 102 causing a rotation of the screw base 104 in a first direction $S_1$ about the socket axis of rotation S.

An artisan will understand that the size, weight and configuration of the LSS Fan 100 is dependent on the physical characteristics of particular lampholder sockets and the manner in which the sockets have been installed in given applications. For example, in residential applications, where the lampholder socket is ceiling mounted and has a medium screw base, the preferred maximum weight is 1.15 kg (2.5 lb.) and the preferred maximum diameter is 216 mm (8.5 in.). The preferred maximum moment, determined by multiplying the weight of the device by the distance between the center contact of the lampholder socked and the center of gravity of the device, is 1.35 N-m (12 lb-in). The weight, diameter and moment may be greater than the preferred maximum, for example, when the lampholder socket is mounted to a support structure and is electrically connected to a power source and the housing 102 has one or more struts 103 connecting the housing 102 to the support structure (see FIG. 18).

The torque limiter 106 is configured to couple the housing 102 to the screw base 104 for rotation therewith when the torque applied to the housing is less than a predetermined magnitude and to couple the housing 201 to the screw base 104 for rotation relative thereto when the applied torque is greater than the predetermined magnitude. Preferred configurations for the torque limiter are further disclosed below. The range of values for the predetermined magnitude for applied torque disclosed above for the first preferred embodiment of the electrical appliance is equally applicable to the LSS Fan 100. In some embodiments, the screw base 104 may be disconnected from the lampholder socket 12 upon a rotation of the screw base 104 in a second direction $S_2$ about the socket axis of rotation S opposite the first direction $S_1$.

Referring to the schematic block diagram of FIG. 1 which is equally applicable to the LSS Fan 100, like numerals indicate like elements in the following description of the components enclosed within the housing 102 of the LSS Fan 100. An electrical motor 24 is mounted to the housing 102 within the motor enclosure 108. In some embodiments, the motor 24 may be a fractional horse power motor. The motor 24 is electrically connected to the screw base 104 by an electrical conductor 22. The motor 24 has a drive shaft 26 rotatable about a motor axis of rotation M spaced from the socket axis of rotation S. The motor 24 is rotatable only in a single motor rotational direction $M_1$ corresponding to the first screw-base rotational direction $S_1$ and does not change due to a reversal of a polarity of the motor. The drive shaft 26 is operatively coupled to a hub 28 rotatably supported by the housing 102. The hub 28 has a hub axis of rotation H coincident with the socket axis of rotation S. At least one impeller 30 is attached to the hub 28 and rotates about the hub axis of rotation H in a first hub rotational direction $H_1$. Both the hub 28 and the at least one impeller 30 may be enclosed within the housing 102. In some embodiments, the electrical device may not be a motor. For example, the electrical device could be a wind driven mobile having an arrangement of light emitting diodes.

In some embodiments, a screw-type lampholder socket 118 may be mounted in the housing bottom 114 and may be electrically connected to the screw base 104. The lampholder socket 118 may be surrounded by a shroud 120 removably secured to the housing bottom 114 by deformable, snap-fit fingers 122 or alternative connectors such as a threaded connection or a bayonet connection. A removable cap 124 similarly connectable to the housing bottom 114 may be provided to prevent inadvertent contact with the lampholder contacts when the lampholder socket 118 is not in use. In some embodiments, the housing bottom 114 may have an arrangement of light emitting diodes 115 arranged in spaced apart relationship around the outer circumference of the bottom housing as shown in FIG. 19.

One embodiment of the torque limiter 106 configured to couple the housing 102 to the screw base 104 is shown in FIGS. 7-13C. The torque limiter 106 comprises a generally circular-shaped torque plate 126 having a centrally positioned torque-plate bore 128 above which extends a hollow generally cylindrical tube 130 having an outer surface shaped to fixedly receive and support the screw base 104. A plurality of arcuate slots 132, desirably at least two slots and preferably three or more slots, are uniformly positioned in the torque plate 126 and are spaced from and around the torque-plate bore 128. A pair of spaced-apart, arcuate-shaped moment arms 134 having a base (or first end) 134*a* formed by the torque plate 126 and a head (or second end) 134*b* having an outwardly projecting faceted surface 136 forming a catch 138 extend along a portion of the outer circumference of the torque plate 126. An indentation 140 in the circumference of the torque plate 126 is positioned proximal to the base 134*a* of each moment arm 134. The torque plate 126 is rotatably attached to the housing top 112 by fasteners 142 that extend from the housing top 112 into and slideable in the arcuate slots 132. In some embodiments, the fasteners 132 may be double headed pins that extend through the housing top 112, are inserted into an enlarged end of each arcuate slot 132 and that are slideably retained in the arcuate slots 132 the torque plate 126 by at least one flexible locking arm 144 that extends over the enlarged end of one of the arcuate slots 132. Mounting posts 141 for joining the housing top 112 to the housing bottom 114 are received in the indentations 140 and in cooperation with the indentations 140 limit the range of rotation of the torque plate 126.

A stop 146 extending from the bottom side of the housing top 112 is positioned to operatively engage each moment arm 134 when the torque plate 126 is coupled to the housing top 112. The stops 146 have a deflecting surface 148 configured to slideably engage the catch 138 of the moment arms 134. Referring to FIG. 13A, prior to insertion of the screw base 104 into a lampholder socket, the torque plate 126 is in a first angular position relative to the housing top 112, the fasteners 142 are proximal to the enlarged end of the arcuate slots 132 and the deflecting surfaces 148 are spaced from the catch 138 of the moment arms 134.

Referring to FIG. 13B, upon insertion of the screw base 104 in a lampholder socket and upon initial application of a torque to the housing 102, the torque plate 126 rotates to a second angular position relative to the housing top 112 in which contact between the deflecting surface 148 of the stops 146 and the catch 138 of the moment arms 134 couples the housing to the screw base 104 for rotation therewith. As the torque applied to the housing 102 increases in magnitude but remains less than the predetermined magnitude, the housing 102 and the screw base 104 rotate in unison threadedly engaging the lampholder socket. When the applied torque exceeds the predetermined magnitude, the radially inwardly directed moment applied by the stop 146 to the moment arms 134 causes the moment arms 134 to deflect radially inwardly. The deflection breaks the contact between the deflecting surface 148 of the stops 146 and the catch 138 of the moment arms 134 allowing the torque plate 126 to rotate relative to the housing 102 to a third angular position as shown in FIG. 13C in which the head 134*a* of the moment arms 134 has moved past the catch 138 of the stops 146.

Another embodiment of a torque limiter, generally designated 150, and hereinafter referred to as the torque limiter 150 configured to couple the housing 102 to the screw base 104 in accordance with the present invention is shown in FIGS. 14A-14D. The torque limiter 150 comprises a torque plate 152 having one or more breakaway members 154 having a first end 156 fixedly attached to the screw base 104 and a second end 158 fixedly attached to the housing top 112 by fasteners 160. The first end 156 breaks away and separates from the second end 158 when the torque applied to the housing 102 is greater than the predetermined magnitude (see FIG. 14D). In some embodiments, the breakaway members 154 may connect an annular outer portion of the torque plate 152 fixedly attached to the housing top 112 to a circular center portion of the torque plate 152 fixedly supporting the screw base 104.

Another embodiment of a torque limiter, generally designated 170, and hereinafter referred to as the torque limiter 170 configured to couple the housing 102 to the screw base 104 in accordance with the present invention is shown in FIGS. 15A-15B. The torque limiter 170 comprises an annular ring 172 fixedly attached to the screw base 104 for rotation therewith. The annular ring 172 is also attached to the housing 102 by fasteners 174 slidable in slots 176 in the annular ring 172. The fasteners 174 are inserted in the slots 176 with a compression (or friction) fit. When a torque applied to the housing 102 is less than the predetermined magnitude discussed above, the fasteners 174 are not slidable in the slots 176; therefore, the housing 102 rotates in unison with the screw base 104. When a torque applied to the housing 102 is greater than the predetermined magnitude, the friction force between the fasteners 174 and the slot walls is overcome allowing the fasteners 174 to slide in the slots 176 and the housing 102 to rotate relative to the screw base 104. The slots 176 in cooperation with the fastener 174 also limit a range of rotation of the annular ring 172 relative to the housing 102.

Another embodiment of a torque limiter, generally designated 180, and hereinafter referred to as the torque limiter 180 configured to couple the housing 102 to the screw base 104 in accordance with the present invention is shown in FIGS. 16A-16B. The torque limiter 180 comprises an annular ring 182 fixedly attached to the screw base 104 and rotatably attached to the housing 102 by a fastener 184 slidable in a slot 186 in the annular ring 182. The slot 186 in cooperation with the fastener 184 limits a range of rotation of the annular ring 182 relative to the housing 102. An arcuate-shaped moment arm 188 is formed by a portion of an outer circumference of the annular ring 182. The moment arm 188 biased radially outwardly. An end portion 188*a* of the moment arm 188 in cooperation with a boss 190 attached to the housing 102 opposes rotation of the annular ring 182 relative to the housing 102 when the torque applied to the housing 102 is less than the predetermined magnitude discussed above (see FIG. 16A). The moment arm 188 in cooperation with a resonator 192 produces an audible signal when the applied torque is greater than the predetermined magnitude and the end portion 188*a* of the moment arm 188 slips past the boss 190 and strikes the resonator 192 notifying the user that the screw base 104 is tightly threaded in the lampholder socket (see FIG. 16B).

Another embodiment of a torque limiter, generally designated 200, and hereinafter referred to as the torque limiter 200 configured to couple the housing 102 to the screw base 104 in accordance with the present invention is shown in FIGS. 17A-17B. The torque limiter 200 comprises a clutch plate 202 fixedly attached to the screw base 104 and rotatably attached to the bottom side of the housing top 112 by a plurality of fasteners 204 having a head, a portion of a first side of which is in slidable contact with the clutch plate 202. The clutch plate 202 has a first slip surface (not shown). A second slip surface 206 is fixedly attached to the bottom side of the housing top 112. The first slip surface of the clutch plate 202 is in frictional contact with the second slip surface 206 (see FIG. 17A). The plurality of fasteners are tightened until the frictional force that must be exceeded before the first sip surface is slideable relative to the second slip surface 206 does not occur until the torque applied to the housing 102 is greater than the predetermined magnitude discussed above and the clutch plate 202 rotates relative to the housing 102 (see FIG. 17B).

In any of the embodiments disclosed above, the torque limiter may have an electro-optical assembly attached to the screw base or the housing and configured to emit an optical signal when the applied torque is greater than the predetermined magnitude. Preferably, the electro-optical assembly has an emitter/detector pair 208 attached to the housing and a reflector 210 attached to the torque limiter (or clutch plate 202) as shown in FIGS. 17A and 17B. The emitter/detector pair 208 initially spaced from the reflector 210 become aligned with the reflector 210 when the applied torque is greater than the predetermined magnitude and the clutch plate 202 rotates relative to the housing 102 creating an signal that may be the input to a warning device alerting the user that the appliance is being over torqued.

The foregoing detailed description of the invention has been disclosed with reference to specific embodiments. However, the disclosure is not intended to be exhaustive or to limit the invention to the precise forms disclosed. Those skilled in the art will appreciate that changes could be made to the embodiments described above without departing from the broad inventive concept thereof. Therefore, the disclosure is intended to cover modifications within the spirit and scope of the present invention as defined by the appended claims.

I claim:

1. An electrical appliance for a lampholder socket having a first lampholder-socket electrically conductive contact, a second lampholder-socket electrically conductive contact insulated from the first lampholder-socket electrically conductive contact and a socket axis of rotation, the appliance comprising:

a housing rotatable by an application of an applied torque thereto;

a screw base configured to be inserted in the lampholder socket and threadedly connected to the lampholder socket upon a rotation of the screw base in a first direction about the socket axis of rotation, the screw base having a first screw-base electrically conductive contact and a second screw-base electrically conductive contact insulated from the first screw-base electrically conductive contact, wherein the first screw-base electrical contact is in electrical communication with the first lampholder-socket electrically conductive contact and the second screw-base electrically conductive contact is in electrical communication with the second lampholder-socket electrically conductive contact when the screw base is threadedly connected to the lampholder socked;

a torque limiter fixedly attached to the screw base for rotation therewith, the torque limiter coupling the housing to the screw base for rotation therewith when the applied torque is less than a predetermined magnitude and coupling the housing to the screw base for rotation relative thereto when the applied torque is greater than the predetermined magnitude; and an electrical device mounted in the housing, the electrical device electrically connected to the screw base.

2. The electrical appliance of claim 1, wherein the predetermined magnitude of the applied torque is less than about 2.26 N-m (20 lb-in).

3. The electrical appliance of claim 1, wherein the screw base is disconnectable from the lampholder socket upon a rotation of the screw base in a second direction about the axis of rotation, the second direction opposite the first direction.

4. The electrical appliance of claim 1, wherein the electrical device is a motor having a drive shaft 26 rotatable about a motor axis of rotation spaced from the socket axis of rotation.

5. The electrical appliance of claim 4, wherein the motor is a fractional horse power motor.

6. The electrical appliance of claim 4, wherein the drive shaft 26 is operatively coupled to a hub rotatably supported by the housing, the hub having a hub axis of rotation coincident with the socket axis of rotation.

7. The electrical appliance of claim 6, wherein at least one impeller is attached to the hub.

8. The electrical appliance of claim 7, wherein the hub and the at least one impeller are enclosed within the housing.

9. The electrical appliance of claim 1, further comprising another lampholder socket mounted in the housing, the another lampholder socket electrically connected to the screw base.

10. The electrical appliance of claim 1, wherein the torque limiter comprises an electro-optical assembly attached to the screw base and configured to emit an optical signal when the applied torque is greater than the predetermined magnitude.

11. The electrical appliance of claim 1, wherein the lampholder socket is mounted to a support structure and is electrically connected to a power source and the housing has a strut connecting the housing to the support structure.

12. The electrical appliance of claim 1, wherein the electrical device is a mobile having an arrangement of light emitting diodes.

13. An electrical appliance for a lampholder socket having a socket axis of rotation, the appliance comprising:

a housing rotatable by an application of an applied torque thereto;

a screw base configured to be inserted in the lampholder socket and threadedly connected to the lampholder socket upon a rotation of the screw base in a first direction about the socket axis of rotation;

a torque limiter fixedly attached to the screw base for rotation therewith, the torque limiter coupling the housing to the screw base for rotation therewith when the applied torque is less than a predetermined magnitude and coupling the housing to the screw base for rotation relative thereto when the applied torque is greater than the predetermined magnitude; and an electrical motor mounted in the housing, the electrical motor electrically connected to the screw base, the electric motor having a drive shaft rotatable about a motor axis of rotation spaced from the socket axis of rotation, wherein the motor is rotatable only in a single motor rotational direction corresponding to the first direction of rotation of the screw base and does not change the single motor rotational direction due to a reversal of a polarity of the motor.

14. An electrical appliance for a lampholder socket having a socket axis of rotation, the appliance comprising:

a housing rotatable by an application of an applied torque thereto;

a screw base configured to be inserted in the lampholder socket and threadedly connected to the lampholder socket upon a rotation of the screw base in a first direction about the socket axis of rotation;

a torque limiter fixedly attached to the screw base for rotation therewith, the torque limiter coupling the housing to the screw base for rotation therewith when the applied torque is less than a predetermined magnitude and coupling the housing to the screw base for rotation relative thereto when the applied torque is greater than the predetermined magnitude; and an electrical device mounted in the housing, the electrical device electrically connected to the screw base, wherein the torque limiter comprises a breakaway member having a first end fixedly attached to the screw base and a second end fixedly attached to the housing, the first end breaking away and separating from the second end when the applied torque is greater than the predetermined magnitude.

15. An electrical appliance for a lampholder socket having a socket axis of rotation, the appliance comprising:

a housing rotatable by an application of an applied torque thereto;

a screw base configured to be inserted in the lampholder socket and threadedly connected to the lampholder socket upon a rotation of the screw base in a first direction about the socket axis of rotation;

a torque limiter fixedly attached to the screw base for rotation therewith, the torque limiter coupling the housing to the screw base for rotation therewith when the applied torque is less than a predetermined magnitude and coupling the housing to the screw base for rotation relative thereto when the applied torque is greater than the predetermined magnitude; and an electrical device mounted in the housing, the electrical device electrically connected to the screw base, wherein the torque limiter comprises:

an annular ring fixedly attached to the screw base and rotatably attached to the housing by a fastener slidable in a slot in the annular ring, the slot in cooperation with the fastener limiting a range of rotation of the annular ring relative to the housing; and an arcuate-shaped moment arm formed by a portion of an outer circumference of the annular ring, the moment arm biased radially outwardly, an end portion of the moment arm in cooperation with a boss attached to the housing opposing rotation of the annular ring relative to the housing when the applied torque is less than a predetermined magnitude.

16. The electrical appliance of claim 15, wherein the moment arm in cooperation with a boss produces an audible signal when the applied torque is greater than the predetermined magnitude.

17. An electrical appliance for a lampholder socket having a socket axis of rotation, the appliance comprising:

a housing rotatable by an application of an applied torque thereto;

a screw base configured to be inserted in the lampholder socket and threadedly connected to the lampholder socket upon a rotation of the screw base in a first direction about the socket axis of rotation;

a torque limiter fixedly attached to the screw base for rotation therewith, the torque limiter coupling the housing to the screw base for rotation therewith when the applied torque is less than a predetermined magnitude and coupling the housing to the screw base for rotation relative thereto when the applied torque is greater than the predetermined magnitude; and an electrical device mounted in the housing, the electrical device electrically connected to the screw base, wherein the torque limiter comprises: a first slip surface fixedly attached to the screw base and a second slip surface fixedly attached to the housing, the first slip surface in frictional contact with the second slip surface, the first slip surface slideable relative to the second slip surface when the applied torque is greater than the predetermined magnitude.

* * * * *